US005267457A

United States Patent [19]

Sorensen et al.

[11] Patent Number: 5,267,457

[45] Date of Patent: Dec. 7, 1993

[54] DOUBLE LATCH DEAD BOLT LOCK OPERATING MECHANISM

[75] Inventors: Birk Sorensen, Whittier; Kent Martins, Hawaiian Gardens, both of Calif.

[73] Assignee: Juralco, Inc., City of Industry, Calif.

[21] Appl. No.: 941,186

[22] Filed: Sep. 4, 1992

[51] Int. Cl.[5] ..... E05B 9/00

[52] U.S. Cl. ..... 70/130; 70/352; 70/DIG. 6; 70/DIG. 42; 70/DIG. 69; 292/150; 292/337; 292/DIG. 51; 292/DIG. 62

[58] Field of Search ..... 70/352, 130, DIG. 42, 70/DIG. 6, DIG. 69; 292/150, 337, DIG. 44, DIG. 62, DIG. 51

[56] References Cited

U.S. PATENT DOCUMENTS

| | | | |
|---|---|---|---|
| 982,863 | 1/1911 | Phillips | 70/352 |
| 1,406,437 | 2/1922 | Block | 70/130 |
| 2,405,240 | 8/1946 | Shearer et al. | 70/130 |
| 2,660,875 | 12/1953 | Jewett et al. | 70/352 |
| 3,026,703 | 3/1962 | Welch | 292/150 X |
| 3,815,390 | 6/1974 | Stoia | 292/150 X |

*Primary Examiner*—Lloyd A. Gall
*Attorney, Agent, or Firm*—Lyon & Lyon

[57] ABSTRACT

An improved double latch dead bolt lock operating mechanism wherein the dead bolt has a keyway engaged by a key for guiding the latching and unlatching movement of the dead bolt but allowing vertical movement of the dead bolt for accommodating any undesired engagement of the operating cam with an improper portion of the dead bolt. The dead bolt is resiliently urged vertically toward the operating cam to return the dead bolt to its normal vertical position after the cam to passes that improper portion of the dead bolt.

11 Claims, 4 Drawing Sheets

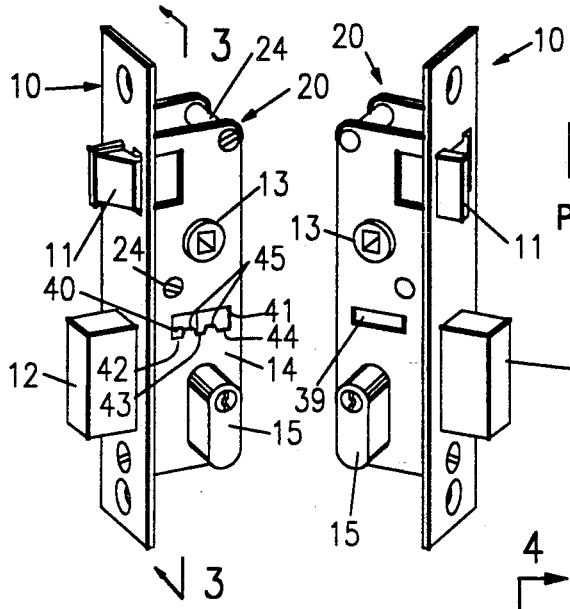
Fig.1
PRIOR ART
Fig.2
PRIOR ART
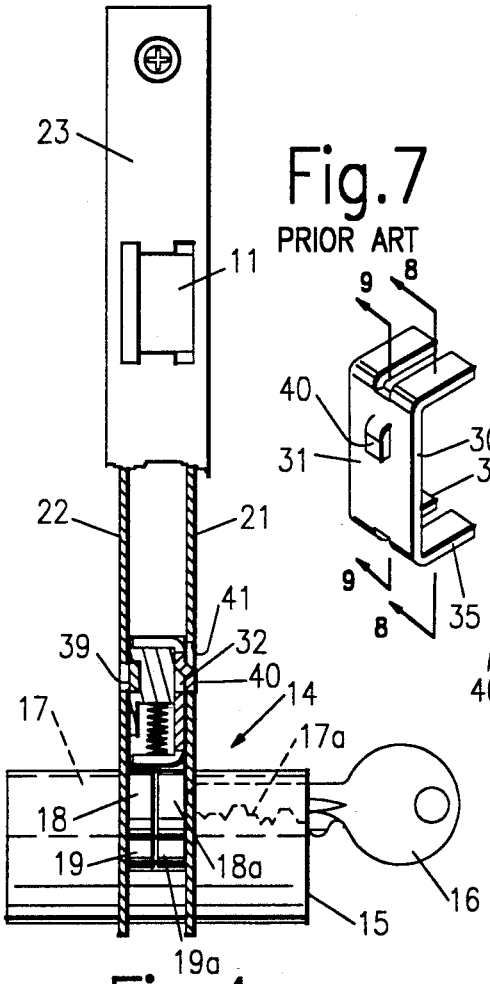
Fig.4
PRIOR ART
Fig.7
PRIOR ART
Fig.8
PRIOR ART
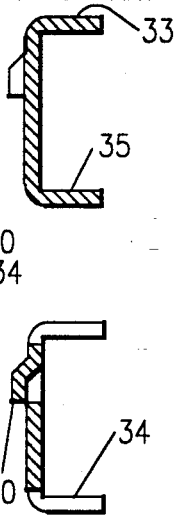
Fig.9
PRIOR ART
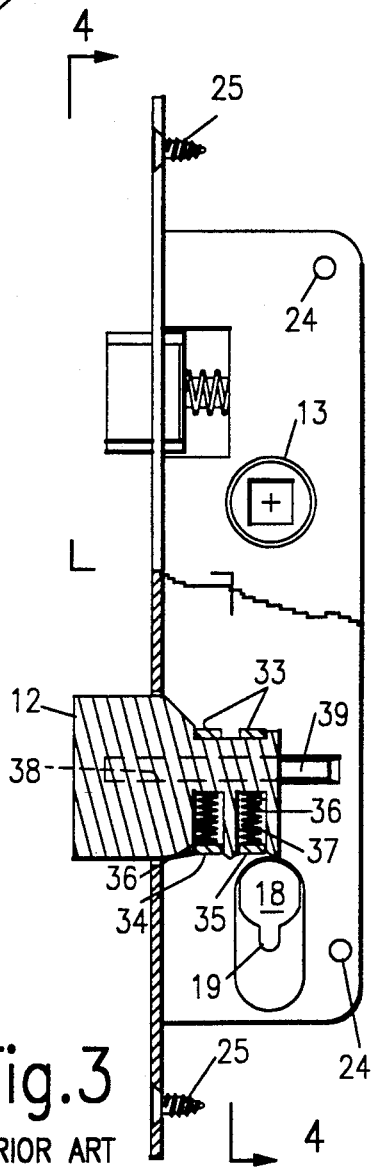
Fig.3
PRIOR ART

DOUBLE LATCH DEAD BOLT LOCK OPERATING MECHANISM

This invention relates to a dead bolt lock operating mechanism for door locks and, in particular, is directed to door locks for use in narrow door frames, wherein the lack of space requires the dead bolt to be latched and unlatched by two separate movements for accomplishing the desired depth of latching movement of the dead bolt.

There are numerous modern doors that use relatively narrow door frames, such as, screen doors, security doors, storm doors, or the like, which door frames may be constructed of wood, steel tubing, aluminum extrusions or the like, wherein it is desirable to have a dead bolt lock for securely closing the door. Although it is desirable that a dead bolt project a substantial distance from the edge of the door into the strike plate in the surrounding door jamb for improving the security and minimizing the possibility of forced entry, the very narrow frame of such doors creates a problem of designing and constructing an operating mechanism that will provide adequate projecting and retracting movement of the dead bolt by only one revolution or less of an operating device, such as a key or knob. As a result, a number of dead bolt operating mechanisms have been developed which produce a so-called double latching movement wherein one revolution of the key or knob causes the dead bolt to project a given distance from the door edge and a second revolution of the key or knob causes the dead bolt to project a still further distance which results in a total distance that is completely adequate for security. The dead bolt is latched in both positions against inadvertent retraction. Similarly, two revolutions of the key or knob in the reverse direction causes partial and then complete retraction. The dead bolt operating mechanisms of these prior art devices are rather complicated and subject to failure or inoperability due to manufacturing tolerances, wear, abuse or the like.

One such prior art double latch dead bolt locking mechanism, as shown in FIGS. 1-6 that will be described below in greater detail, uses a cam that is rotated by the key or knob to simultaneously engage a bolt latch mechanism and a first portion of the dead bolt for releasing the latch mechanism and causing movement of the dead bolt for a first distance during a first revolution of the key or knob and then the cam engages the bolt latch mechanism again and a second portion of the dead bolt for releasing the latch mechanism again and moving the dead bolt a second distance during a second revolution of the key or knob, thereby accomplishing the double latch movement. While this mechanism is of a sufficiently small size to fit a narrow door frame, it has the inherent problem of requiring precise interengagement of the rotating cam with two separate portions of the dead bolt, engaging the bolt latch mechanism for simultaneously unlatching the dead bolt, and not engaging some additional portion of the dead bolt or bolt latch mechanism that would prevent the necessary rotation of the cam. This problem is further aggravated by the demand for low manufacturing costs, whereby the precision with which each of the components of the operating mechanism can be manufactured is reduced. Specifically, many of the assembled door locks of this type must be rejected as inoperative as a result of the cam either engaging improper portions of the dead bolt, thereby preventing rotation of the cam and the desired movement of the dead bolt, or insufficient engagement of the proper portions of the dead bolt by the cam, thereby causing insufficient movement of the dead bolt by the cam and the double latching movement cannot be accomplished.

By the present invention, a double latch type dead bolt lock operating mechanism is provided with a cooperating dead bolt, latch and cam assembly that allows biased movement of the dead bolt to ensure proper operation regardless of improper interference between the cam and dead bolt as a result of manufacturing tolerances, abuse, wear or the like, without significantly increasing the difficulty or cost of manufacture of the lock.

It is an object of this invention to provide a simple and efficient design of a double latch type dead bolt lock operating mechanism that can be easily and inexpensively manufactured in mass quantities with ample manufacturing tolerances and yet without effecting the proper operation of the assembled product.

It is a further object of this invention to provide an improved construction for a double latch type dead bolt lock operating mechanism, wherein the dead bolt is resiliently retained in the vertical direction throughout the horizontal latching and unlatching movement of the dead bolt for allowing vertical movement of the dead bolt to ensure proper interengagement with the cam during both steps of movement in both latching and unlatching directions and yet the dead bolt is securely latched in the fully extended, intermediate and fully retracted positions.

Other and more detailed objects and advantages of the present invention will appear to those skilled in the art from the following description of the preferred embodiment in comparison with the prior art device, both of which are shown in the accompanying drawings, wherein:

FIG. 1 is a perspective view of one side of a prior art lock that includes a double latched type dead bolt lock and operating mechanism;

FIG. 2 is a perspective view of the other side of the prior art lock shown in FIG. 1;

FIG. 3 is an enlarged elevation view of the prior art lock shown in FIGS. 1 and 2, with portions shown in sections, taken substantially along the line 3—3 in FIG. 1;

FIG. 4 is a front elevation view of the prior art lock shown in FIGS. 1-3, with portions shown in section, taken substantially along the line 4—4 in FIG. 3;

FIG. 7 is a perspective view of the latch element that is incorporated in the prior art lock shown in FIGS. 1-6;

FIG. 8 is a sectional elevation view of the latch element taken substantially on the line 8—8 of FIG. 7;

FIG. 9 is a sectional elevation view of the latch taken substantially on the line 9—9 shown in FIG. 7;

Figure 10:
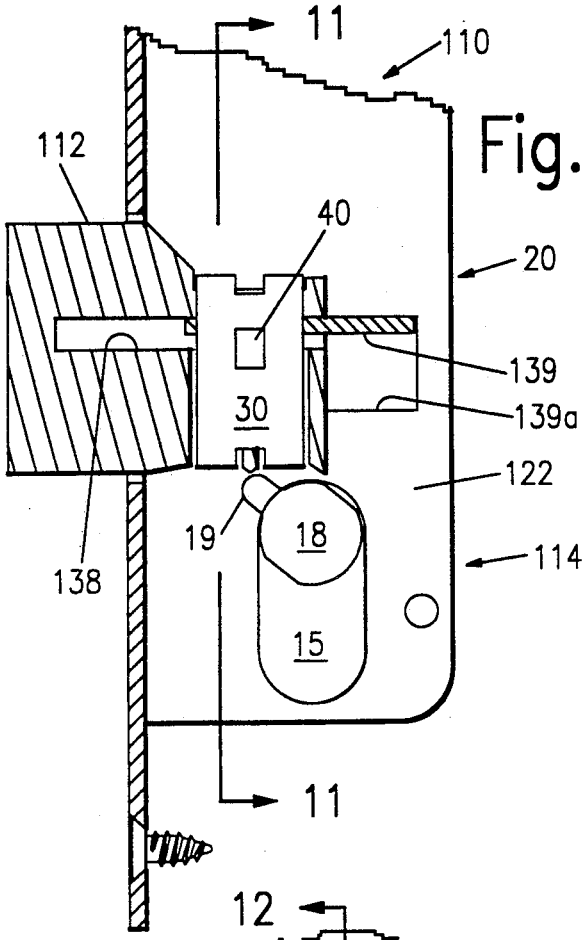
FIG. 10 is a sectional side elevation view of the improved dead bolt lock operating mechanism of the present invention, which view is similar to FIG. 5 illustrating the prior art lock mechanism.
Figure 12:
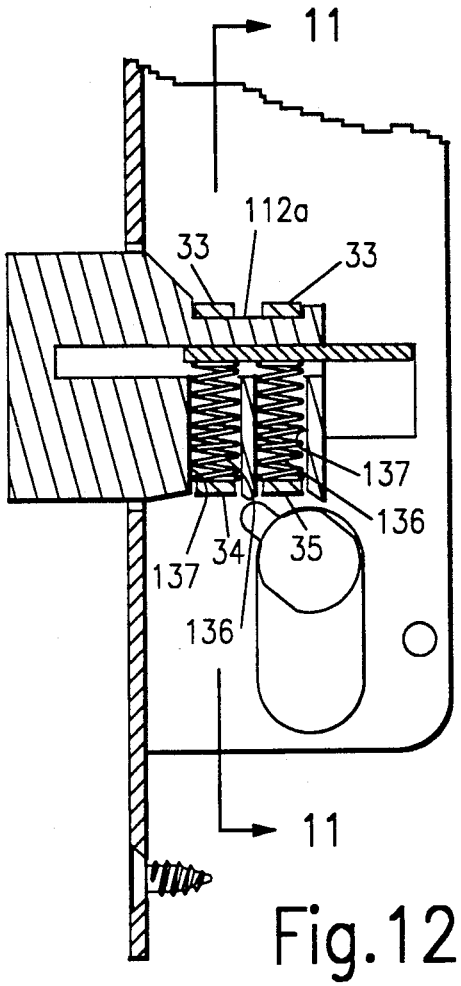
Figure 11:
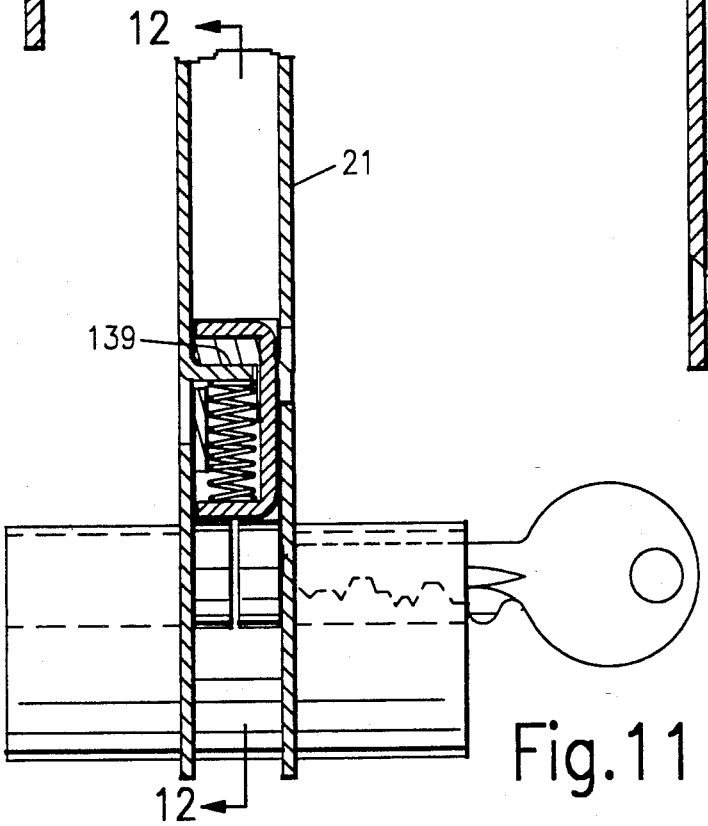

FIG. 11 is a sectional front elevation view of the improved dead bolt lock operating mechanism of this invention taken substantially on the lines 11—11 shown in FIGS. 10 and 12; and FIG. 12 is a sectional side elevation view similar to FIG. 10 but taken substantially on the line 12—12 shown in FIG. 11.

Figure 13:
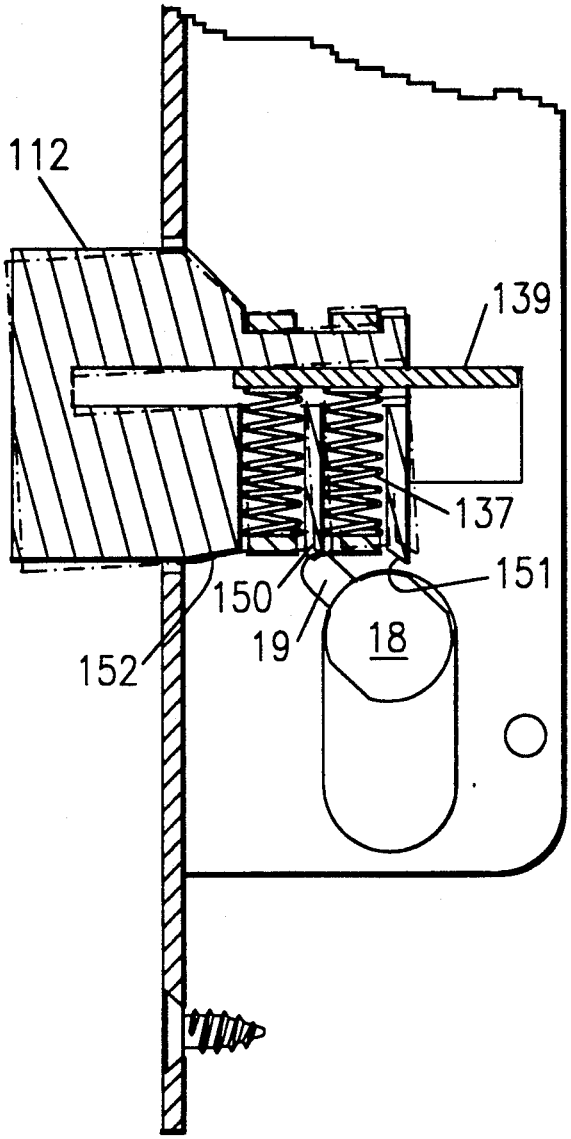

FIG. 13 is a sectional side elevation view similar to FIG. 12 but illustrating a different operating condition.

Referring first to FIGS. 1–4 that illustrate the prior art lock assembly, generally designated 10, of which the present invention is an improvement in the dead bolt lock operating mechanism, the lock assembly 10 includes both a convenience latch 11 and a dead bolt 12. The convenience latch 11 is tapered on one side for automatically retracting upon closing of the door in a conventional manner. A rotary operating mechanism 13 is provided with a handle (not shown) on each side of the door (also not shown) for retracting the convenience latch 11 in a conventional manner for opening the door. The convenience latch 11 and its rotary operating mechanism 13 are not related to the subject invention and, therefore, will not be described in further detail.

The dead bolt 12 is of a relatively large size and projects a substantial distance from the lock assembly 10 for securely locking the door to the door jamb (not shown). A dead bolt operating assembly, generally designated 14, is provided for causing extension and retraction of dead bolt 12 in a manner hereinafter described.

The lock assembly 10 includes a housing, generally designated 20, for supporting the convenience latch 11, dead bolt 12, rotary mechanism 13 and the dead bolt operating assembly 14. The housing 20 is comprised of a right side plate 21, a left side plate 22 and an escutcheon plate 23 that abuts the front edges of and is attached to the right and left side plates 21 and 22. In addition, a series of spacer and fastener assemblies 24 extend between and connect the side plates 21 and 22 for creating a rigid housing in which the side plates 21 and 22 are held in a parallel, spaced condition. The convenience latch 11 and the dead bolt 12 extend through appropriately shaped openings in the escutcheon plate 23. The entire housing 20 is very narrow in both horizontal directions for fitting into a very narrow door frame made of metal tubing or extrusion or wood that is conventionally used in screen doors, storm doors, security doors and the like that have a narrow door frame surrounding a large central opening that is covered by screening, grating, bars, plastic, glass or the like. As a result, there is very little space in both horizontal directions (width and thickness) for accommodating the lock operating mechanisms. However, for adequate security, the dead bolt lock mechanism requires a relatively large size dead bolt 12 that must be operated to project and retract a substantial distance to engage a hole in a strike plate (not shown) mounted in a door jamb (not shown) in a secure manner that precludes forced entry through the door when the dead bolt is in the extended, locked condition. As will be apparent to those skilled in the art, the tall but narrow housing 20 of this lock assembly 10 will be readily accommodated in a narrow door frame and secured by a pair of screws through holes at the top and bottom of the escutcheon plate 23 in a conventional manner and appropriate knobs and handles will extend outwardly from the door frame for operating the mechanisms 13 and 14 for in turn latching and unlatching the convenience latch 11 and dead bolt 12, respectively, in a conventional manner.

As shown in the drawings, the dead bolt operating assembly 14 may include a lock mechanism 15 operable by a key 16 from either side of the door or the inside of the door may be provided with a knob (not shown) attached to a cylinder 17 for causing the same type of rotary movement that is accomplished by the key 16 for extending and retracting the dead bolt 12. On the interior end of cylinder 17 is provided a cam 18 which has a cam lobe 19 extending radially outward from the main body of the cam 18. Similarly, the cylinder 17*a* that is rotated by the key 16 has a cam 18*a* with a cam lobe 19*a* at the interior end. Both cams 18 and 18*a* function in the same manner so only the operation of cam 18 will be described hereinafter.

Because of the very narrow space available for the dead bolt operating assembly 14, the mechanism is designed to cause two separate horizontal movements of the dead bolt 12 during the extension or retraction phases of operation, which is known as a double latch dead bolt system. The particular form of mechanism of which the present invention is an improvement includes a movable latch 30 (see FIGS. 7–9) that is mounted on the interior end of the dead bolt 12 and serves to latch the dead bolt 12 in each of three positions, namely, fully extended or latched, an intermediate latched position and a fully retracted or unlatched condition. The latch 30 is C-shaped with a vertical portion 31 that fits in a vertical slot 32 in dead bolt 12 for capturing the latch 30 between the dead bolt 12 and right side plate 21, whereby the latch 30 moves horizontally with the dead bolt 12 but can slide vertically relative to the dead bolt 12. The upper flange 33 of latch 30 is adapted to engage the top of the dead bolt 12 for limiting the downward movement of the latch and flange 33 may be in the form of a pair of fingers, as shown. The lower flange of latch 30 is in a form of fingers 34 and 35 which extend into a pair of grooves 36 in the bottom of the dead bolt 12. A pair of compression coil springs 37 are positioned in the grooves 36 for resiliently urging the fingers 34 and 35 downwardly relative to the dead bolt 12.

The dead bolt 12 has a horizontal groove or keyway 38 in the left side (as viewed in FIG. 4) and a rectangular portion of the side plate 22 is deformed inwardly to form a key 39 that extends into and mates with the keyway 38 of the dead bolt 12 for guiding the horizontal movement of the dead bolt 12 during extension and retraction. The shapes and sizes of the keyway 38 and key 39 are such as to prevent any substantial vertical movement of the dead bolt 12 and normally the vertical movement is limited to about 0.010 inch.

The vertical portion 31 of the latch 30 is formed with a lug 40 that extends into an opening 41 in the right side plate 21. The opening 41 is generally rectangular, as shown in FIG. 1 and in dashed lines in FIGS. 6A–6E, and is provided with three notches 42, 43 and 44 along the bottom edge, which notches are formed on either side of and between two upwardly extending protrusions 45 integral with the side plate 21. The lug 40 of latch 30 fits snugly in each of the notches 42, 43 and 44, depending on the horizontal position of the dead bolt 12, to provide the fully latched, intermediate and unlatched positions, respectively, of the dead bolt 12. The sides of the protrusions 45 are somewhat tapered to assure entry of the lug 40 into each of the notches 42, 43 and 44 from a position thereabove as a result of the downward biasing force on the latch 30 by the springs 37. Thus, for example, as shown in FIG. 1, the dead bolt 12 is in the fully extended position with the lug 40 fitting in the front most notch 42.

Figure 6A:
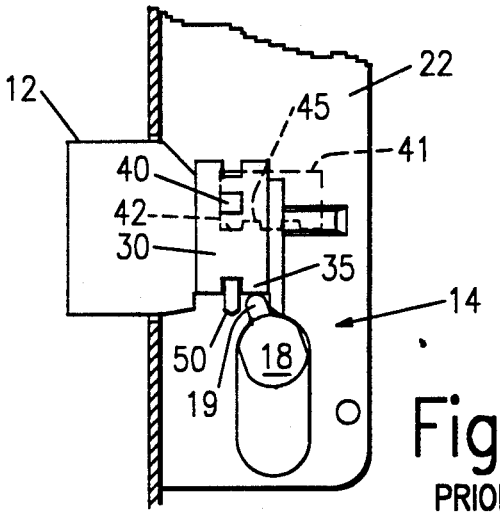
Fig.6A PRIOR ART
FIGS. 6A through 6E are sectional side elevation views similar to FIG. 5 illustrating different positions of the cam, dead bolt and other elements of the prior art lock.
Figure 6B:
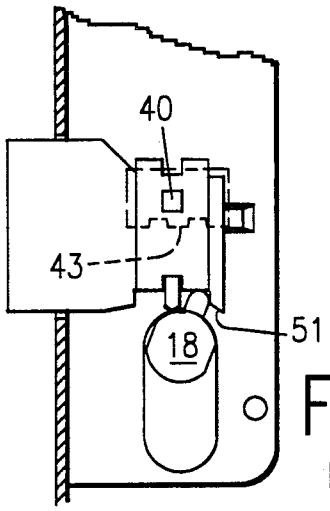
Fig.6B PRIOR ART
Figure 6C:
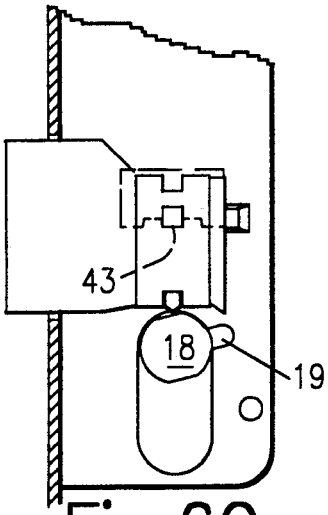
Fig.6C PRIOR ART
Figure 6D:
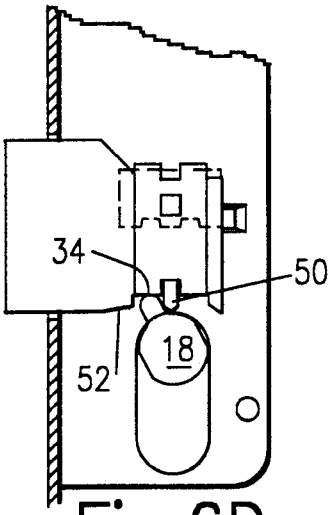
Fig.6D PRIOR ART
Figure 6E:
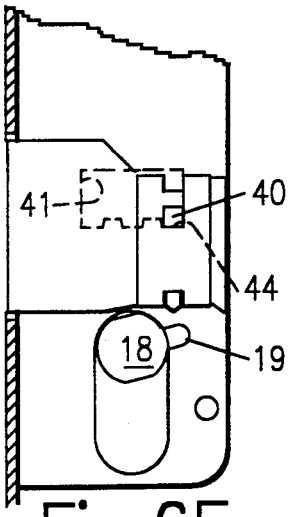
Fig.6E PRIOR ART

Referring more particularly to FIGS. 6A–6E, the operation of the double latch dead bolt operating assembly 14 will now be described. In FIG. 6A, the dead bolt 12 is in the fully extended position but is about to be retracted by clockwise rotation of the cam 18 by reason of rotation of the cylinder 17. The very same operational procedure and motion will occur if the key 16 is rotated in a clockwise direction to rotate cylinder **17*a* and cam 18*a* in a clockwise direction, all as viewed in FIG. 6A. From the normal, unlocked condition of the lock 15 with the cam lobe 19 extending downwardly as shown in FIG. 3, the cam lobe 19 has been rotated approximately 150° to the position shown in FIG. 6A past a central abutment 50 on dead bolt 12 to engage finger 35 on latch 30 to urge latch 30 upwardly in opposition to the biasing force of springs 37 to an elevation where the lug 40 is displaced from the notch 42 by a distance greater than the height of the left hand protrusion 45. Upon further clockwise rotation of cam 18, as shown in FIG. 6B, the cam lobe 19 engages a right hand abutment 51 on dead bolt 12 to cause retracting movement of dead bolt 12 while continuing to maintain the latch 30 in the elevated position by simultaneous engagement of the finger 35, thereby allowing the lug 40 to pass over the left hand protrusion 45 to a position above notch 43. Upon still further clockwise rotation of cam 18, the cam lobe 19 rotates past the abutment 51 and downwardly away from the finger 35 to allow the latch 30 to be urged downwardly by the springs 37 for the lug 40 to enter the notch 43, as shown in FIG. 6C. Upon approximately 270° additional clockwise rotation of cam 18 to the position shown in 6D, the cam lobe 19 engages finger 34 of latch 30 to again urge latch 30 upwardly and lug 40 out of notch 43 by an amount greater than the height of protrusions 45 and the cam lobe 19 engages the left hand side of the central abutment 50 for causing additional unlatching movement of the dead bolt 12 in the right hand direction. The further clockwise rotation of cam 18 eventually results in the cam lobe 19 passing the central abutment 50 and allowing the latch 30 to move downwardly to cause the lug 40 to enter the notch 44 as shown in FIG. 6E to fully retract the dead bolt 12. Thus, by two full revolutions (actually less than 720° is required), the dead bolt is moved from the fully extended or latched position shown in FIG. 6A, to the intermediate latched position shown in FIG. 6C, to the fully retracted or unlatched position shown in FIG. 6E by this very compact dead bolt operating assembly 14. In each of the three positions the dead bolt 12 is latched against horizontal movement in either direction by the lug 40 being positioned in a notch 42, 43 or 44**.

For causing the dead bolt 12 to be extended from the unlatched condition shown in FIG. 6E to the fully latched condition shown in FIG. 6A, the cam 18 is rotated in a counterclockwise direction to essentially reverse the steps described above. Specifically, when the cam 18 is rotated counterclockwise from the position shown in FIG. 6E, the cam lobe 19 will engage finger 34 of latch 30 to lift the lug 40 out of notch 44 and then the cam lobe 19 will engage a left hand abutment 52 on dead bolt 12 to cause the dead bolt to move to the left in the latching direction, approximately as shown in FIG. 6D, although the contact between the cam lobe 19 and abutment 52 is not shown in FIG. 6B because that FIGURE illustrates the dead bolt being moved in the opposite direction. Further counterclockwise rotation of cam 18 allows the dead bolt to be latched in the intermediate position shown in FIG. 6C and then cam lobe 19 again lifts the latch 30 by engaging finger 35 and the cam lobe 19 engages the right hand side of central abutment 50 to cause further left hand movement to the fully latched position shown in FIG. 6A, although again the cam lobe 19 is not shown as engaging the right hand side of abutment 50 because that FIGURE illustrates the opposite movement of the dead bolt. It will be noted that the central abutment 50 has tapered sides on its end for clearance of the cam lobe 19 and the right and left abutments 51 and 52 are also tapered for precise clearance of the cam lobe 19 during rotation of the cam 18 in one direction or the other.

Figure 5:
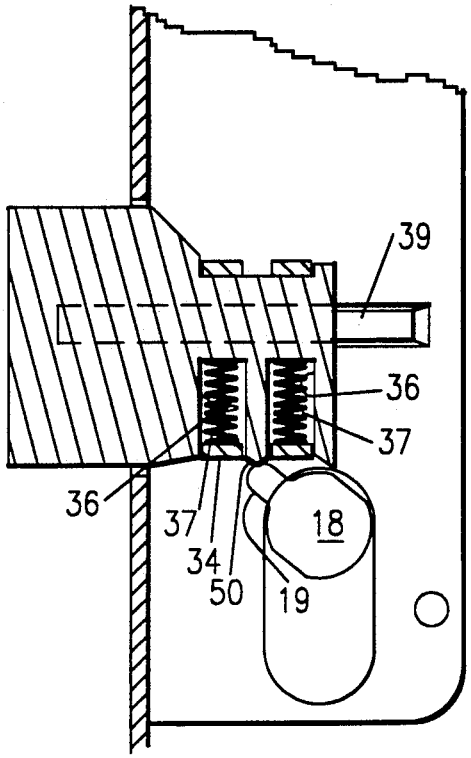
Fig.5 PRIOR ART
FIG. 5 is a further enlarged sectional side elevation of a portion of the prior art lock shown in FIG. 3 with the operating cam in a position illustrating undesirable interference between the cam and dead bolt.

When the size, shape, machining, assembly, etc. of all of the components of the above-described prior art lock assembly 10 are properly and accurately controlled, the dead bolt operating assembly 14 functions properly in the afore-described manner to cause the double latch type latching and unlatching movement of the dead bolt 12. However, locks of this type must be manufactured inexpensively to be saleable and, therefore, the components such as the side plates 21 and 22, escutcheon plate 23 and latch 30 are mass produced by punch press machines that cut and form the components. Further, other components such as the cams 18 and **18*a* and the dead bolt 12 are made by a die casting process to avoid or minimize any machining operation. As a result, the various components of the lock 10 may vary in size and shape and following assembly their spacing may not be precisely as intended. Thus, it has been found that a significant number of the mass produced lock assemblies 10 of this design do not function properly and must be discarded or reworked. For example, as shown in FIG. 5, if the cam lobe 19 is slightly longer than ideal or if the cam 18 is positioned slightly closer to the dead bolt 12 than ideal, such as by the spacing between the key 39 and the lock mechanism 15 being smaller than ideal, or the central abutment 50 is longer than ideal, the cam lobe 19 will improperly engage the central abutment 50 during its clockwise rotation as described with respect to FIG. 6A and further rotation will be prevented by the abutment 50, thereby making it impossible to unlatch the dead bolt. Similarly, if the left hand abutment 52 is engaged by the cam lobe 19 during clockwise rotation between the conditions shown in FIGS. 6C and 6D, further rotation of the cam 18 will be prevented and unlatching from the intermediate position will be prohibited. Similarly, in the counterclockwise unlatching rotation of cam 18 from the position shown in FIG. 6E, the cam lobe 19 may engage the central abutment 50 or from the position shown in FIG. 6C, the cam lobe may engage the right hand abutment 51, thereby preventing further rotation of the cam 18 and the desired latching movement. Moreover, if the cam lobe 19 is shorter than desired or the spacing between the cam 18 and dead bolt 12 is excessively increased, either because of faulty manufacturing or in an attempt to avoid these improper interfering engagements, the cam lobe 19 may not cause sufficient upward movement of the latch 30 for the lug 40 to be displaced from one of the notches 42, 43 or 44 and clear the protrusions 45, whereby horizontal movement of the dead bolt 12 will be prevented by the upward protrusions 45 which again renders the lock assembly 10** useless.

By the present invention, the afore-described deficiencies of the prior art lock assembly 10 have been overcome without requiring more precisely made components or more precise assembly or any additional components, whereby the cost is not increased. Components of the device incorporating this invention that are the same as the prior art device will be identified by the same numerals and components that are new or different will be identified by numerals in the 100 series. Referring now to FIGS. 10–13 that illustrate the improved dead bolt operating assembly 114 of this invention, a preferred embodiment is illustrated that uses the same dead bolt lock assembly 15 with cam 18 having a cam lobe 19 although, as will appear below, the cam lobe 19 may be of greater length to ensure that the latch 30 is adequately lifted for the lug 40 to always clear the protrusions 45 to allow latching and unlatching movement of the dead bolt 112. The housing 20 is generally the same except that the left side plate 122 differs from left side plate 22 in the manner in which the key is formed. In this preferred embodiment, the key 139 is punched from an opening 139*a* in the side plate 122 and extends inwardly a substantial distance toward the right side plate 21, as shown in FIG. 11. The groove or keyway 138 in dead bolt 112 is of a substantially greater depth than keyway 38 of the prior art device for accommodating the key 139. Further, the holes 136 continue upwardly through the dead bolt 112 into the keyway 138 rather than being blind holes or grooves 36 as described with respect to the prior art device. The pair of coil compression springs 137 are mounted in the holes 137 with the bottom ends of the springs 137 engaging the fingers 34 and 35 of the latch 30. The upper ends of the coil springs 137 engage the downwardly facing surface of the key 139, whereby the compression springs 137 resiliently urge both the latch 30 and the dead bolt 112 downwardly by reason of the upper flange 33 of the latch 30 engaging an upwardly facing surface 112*a* of the dead bolt 112. This is to be contrasted with the prior art device wherein the dead bolt 12 was mounted for confined horizontal movement by reason of the interengagement of the keyway 38 and key 39 with no resilient support or movement of the dead bolt 12. Further, the vertical dimension of the keyway 138 is substantially greater than the vertical dimension or thickness of the key 139 for allowing vertical movement of the dead bolt 112 relative to the key 139 and in the preferred embodiment there is approximately 0.050 inch of movement. In all other respects, the construction and operation of this improved dead bolt operating assembly 114 is the same as the afore-described prior art device and operates in the same manner as described with respect to FIGS. 6A-6E. The fact that the key 139 does not closely mate with the keyway 138 to physically confine the dead bolt 112 against any vertical movement does not change the latching and unlatching motions of the dead bolt 112, latch 30 and cam 18 unless there is a problem with the shape, size, machining, assembly, etc. of the components.

As shown in FIG. 13, which is an exaggerated condition for illustration purposes, if the cam lobe 19 of a given cam installed in a lock assembly 110 of this invention is excessively long, then it will engage the central abutment 50 as described above with respect to FIG. 5, but with the present invention the dead bolt 112 is lifted vertically by the cam lobe 19 in opposition to the springs 137, whereby the cam lobe 19 will be allowed to pass the central abutment 150 and then the dead bolt 112 will be resiliently urged downwardly by the springs 137 to its normal position. Upon further clockwise rotation of cam 18 from the position shown in FIG. 13, the latch 30 will be lifted as shown in FIG. 6A while the cam lobe 19 simultaneously engages the abutment 151 to start the retracting movement of the dead bolt 112 as shown in FIG. 6B. Similarly, if the size, shape, etc. of the components cause improper engagement of the cam lobe 19 with other portions of the dead bolt 112 such as abutments 151 or 152 during rotation of the cam 18 in either direction, the dead bolt 112 will merely be lifted from the key 139 until the cam lobe 19 passes the obstructing abutment. Thus, by the present invention, the basic operation of the double latch dead bolt operating mechanism is not adversely affected by the resilient support of the dead bolt 112 but rather it serves to accommodate any imperfections in the manufacturing or assembly of the dead bolt operating assembly 114 in the manner described.

Although a specific embodiment of the present invention has been described in connection with a specific embodiment of a prior art double latch dead bolt lock operating mechanism, it will readily appear to those skilled in the art that the improvements of the present invention are applicable to other prior art lock operating mechanisms having similar problems and that various modifications of the preferred embodiment described herein may be made without departing from the improvement of this invention.

What is claimed is:

1. In a dead bolt lock operating mechanism having a housing for mounting in a door frame, a dead bolt mounted in the housing for latching and unlatching movement, a cam rotatably mounted in the housing for engaging the dead bolt upon selective rotation of the cam to cause latching or unlatching movement of the dead bolt, and a latch for latching the dead bolt in unlatched and latched positions, an improvement comprising, the dead bolt and the housing having a cooperating means causing guided latching and unlatching movement of the dead bolt and allowing limited movement of the dead bolt in a direction toward and away from the cam, the latch having means for engaging cooperating means on the housing for latching the dead bolt to the housing, means for biasing the latch in a latching direction and both the latch and the dead bolt toward the cam for allowing the limited movement of the dead bolt relative to the cam for the cam to pass, by engaging and moving the dead bolt in said direction of said limited movement, interfering portions of the dead bolt and resiliently returning the dead bolt to a normal position during the selective rotation of the cam for latching and unlatching the dead bolt.

2. The improved mechanism of claim 1, wherein said means for biasing the latch and dead bolt include two springs spaced in the direction of latching and unlatching movement of the dead bolt.

3. The improved mechanism of claim 1, wherein the cam engages two separate portions of the dead bolt upon two successive rotations of the cam.

4. The improved mechanism of claim 1, wherein said cooperating means on the dead bolt and housing include a keyway and a key extending in said latching and unlatching direction and having respective dimensions for allowing said limited movement perpendicular to latching and unlatching direction.

5. The improved mechanism of claim 1, wherein said means for biasing the latch and dead bolt include springs mounted in the dead bolt and engaging both the latch and housing.

6. The improved mechanism of claim 5, wherein said cooperating means on the dead bolt and housing include a key on the housing and a keyway in the dead bolt, and said springs engage said key.

7. In a dead bolt lock operating mechanism of the double latch type having a housing for mounting in a door frame, a dead bolt slidably mounted in the housing for horizontal latching and unlatching movement, a cam rotatably mounted in the housing for engaging, upon selective rotation, two separate locations on the dead bolt upon successive rotations of the cam in one direction to use two separate latching or unlatching movements of the dead bolt, and a latch movably mounted in the housing for latching the dead bolt in three positions of unlatched, intermediately latched and fully latched, the latch being engaged and released by the cam during the selective rotation, an improvement comprising, the dead bolt having a keyway, extending horizontally in a direction of the latching and unlatching movement, the housing having a key extending horizontally in the latching and unlatching direction and projecting into said keyway for guiding the horizontal movement of the dead bolt, the latch being mounted on the dead bolt for vertical movement with means for selectively engaging cooperating means on the housing for latching the dead bolt to the housing in the three positions, a pair of compression coil springs mounted in the dead bolt to extend vertically between the latch and said key for biasing the latch in a latching direction and biasing both the latch and the dead bolt vertically toward the cam, and said keyway and key being of cooperating shapes and dimensions for allowing substantial but limited vertical movement of the dead bolt relative to the cam for in turn allowing the cam to pass, by engaging and vertically moving the dead bolt, interfering portions of the dead bolt that the cam engages during the selective rotation of the cam for latching and unlatching the dead bolt.

8. The improved mechanism of claim 7, wherein said key is comprised of a flange formed integrally with the housing and projecting into the keyway.

9. The improved mechanism of claim 8, wherein said coil springs directly engage said flange.

10. The improved mechanism of claim 9, wherein said coil springs are positioned in through holes in the dead bolt and directly engage the latch.

11. The improved mechanism of claim 7, wherein said key and keyway allow approximately 0.050 inch of said limited vertical movement of the dead bolt.

* * * * *